US010084253B2

(12) United States Patent
Ribas et al.

(10) Patent No.: US 10,084,253 B2
(45) Date of Patent: Sep. 25, 2018

(54) ELECTRICAL UNIT AND HEADER RETENTION SYSTEM THEREFOR

(71) Applicant: Lear Corporation, Southfield, MI (US)

(72) Inventors: Ferran J. Ribas, Valls (ES); Montserrat P. Pedret, Valls (ES); Enric A. Rollan, Valls (ES); Joan I. Ferran Palau, Valls (ES); Jose A. Cubero Pitel, Valls (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 15/444,361

(22) Filed: Feb. 28, 2017

(65) Prior Publication Data

US 2017/0279208 A1 Sep. 28, 2017

Related U.S. Application Data

(60) Provisional application No. 62/312,861, filed on Mar. 24, 2016.

(51) Int. Cl.
*H01R 12/71* (2011.01)
*H01R 13/627* (2006.01)

(52) U.S. Cl.
CPC ..... *H01R 12/716* (2013.01); *H01R 13/6273* (2013.01)

(58) Field of Classification Search
CPC ..... H01R 13/514
USPC ..... 439/701, 540.1, 355
See application file for complete search history.

(56) References Cited

U.S. PATENT DOCUMENTS 4,072,379 A * 2/1978 Towne ..... H01R 25/006 439/122
5,090,920 A * 2/1992 Casey ..... H01R 13/514 439/355
5,266,047 A * 11/1993 Black ..... H01R 13/631 439/364
5,318,464 A 6/1994 DiMondi et al.
5,415,566 A * 5/1995 Brunker ..... H01R 23/688 439/607.11
5,423,698 A * 6/1995 Edgley ..... H01R 13/432 439/441
5,580,283 A * 12/1996 O'Sullivan ..... H01R 13/514 439/607.01
5,816,854 A * 10/1998 Baggett ..... H01R 9/2608 439/355
5,895,289 A 4/1999 Smith
6,123,584 A * 9/2000 Van Koetsem .... H01R 13/6599 439/108
6,231,398 B1 * 5/2001 Furutani ..... H01R 13/506 439/701
6,409,525 B1 6/2002 Hoelscher et al.
(Continued)

*Primary Examiner* — Tulsidas C Patel
*Assistant Examiner* — Marcus Harcum
(74) *Attorney, Agent, or Firm* — Fishman Stewart PLLC

(57) ABSTRACT

An electrical unit includes a housing member, a circuit board, a header connected to the housing member, and a plurality of electrical terminals disposed in the header and connected to the circuit board. The header may be connected to the housing member such that movement of the header is restricted and forces applied to the circuit board via the housing member are limited. The header may include a retainer configured to retain the header relative to the housing member. The housing member may include a latch configured to engage the retainer.

23 Claims, 14 Drawing Sheets

(56) References Cited

U.S. PATENT DOCUMENTS

| | | | | |
|---|---|---|---|---|
| 6,413,119 | B1 * | 7/2002 | Gabrisko, Jr. | H01R 13/719 439/620.05 |
| 6,443,779 | B2 * | 9/2002 | Suzuki | H01R 9/2425 439/557 |
| 7,331,801 | B1 | 2/2008 | Eichorn | |
| 7,351,091 | B1 | 4/2008 | Zhang et al. | |
| 7,361,055 | B2 * | 4/2008 | Fuerst | H01R 13/514 439/620.09 |
| 7,445,471 | B1 * | 11/2008 | Scherer | H01R 13/506 439/108 |
| 7,467,955 | B2 * | 12/2008 | Raistrick | H01R 13/26 439/75 |
| 7,492,600 | B2 | 2/2009 | Kane | |
| 7,553,170 | B2 * | 6/2009 | Minich | H01R 43/0256 439/83 |
| 7,611,359 | B2 | 11/2009 | Tomizu et al. | |
| 7,717,720 | B2 * | 5/2010 | Ikeda | H01H 50/048 439/701 |
| 8,475,177 | B2 * | 7/2013 | Crofoot | H01R 9/0515 439/61 |
| 8,668,522 | B2 * | 3/2014 | Becker | H01R 13/514 439/607.02 |
| 8,784,132 | B2 | 7/2014 | Cossette | |
| 9,362,694 | B2 | 6/2016 | Flender et al. | |
| 9,640,901 | B2 * | 5/2017 | Hasegawa | H01H 50/048 |
| 2002/0098727 | A1 * | 7/2002 | McNamara | H01R 23/688 439/108 |
| 2007/0141871 | A1 * | 6/2007 | Scherer | H01R 23/688 439/108 |
| 2010/0130067 | A1 * | 5/2010 | Hsu | H01R 13/514 439/656 |
| 2012/0052710 | A1 * | 3/2012 | Deehr | A61N 1/375 439/345 |

* cited by examiner

ELECTRICAL UNIT AND HEADER RETENTION SYSTEM THEREFOR

CROSS-REFERENCE TO RELATED APPLICATION

This application claims the benefit of U.S. Provisional Application Ser. No. 62/312,861, filed Mar. 24, 2016, the disclosure of which is hereby incorporated herein by reference in its entirety.

TECHNICAL FIELD

The present disclosure relates to circuit boards, headers, electrical units, power distribution units, electrical junction boxes, electrical housings, electronic control units, gateway units, and body domain controllers, including those that may be used in vehicles.

BACKGROUND

This background description is set forth below for the purpose of providing context only. Therefore, any aspects of this background description, to the extent that it does not otherwise qualify as prior art, is neither expressly nor impliedly admitted as prior art against the instant disclosure.

In some circumstances, connector mating operations (e.g., between connectors and/or units, such as junction boxes and/or wiring harness connectors) may result in relatively large amounts of strain being transferred to, applied to, and/or experienced by a circuit board (e.g. a printed circuit board (PCB)). For example, for cost saving purposes, a connection mating element may be formed with pin terminals grouped in a header that may be separate from a connection housing, which may be part of an electrical unit (e.g., as opposed to a complete connector device in which the connection housing may be integrated with pin terminals).

There is therefore a desire for solutions/options that minimize or eliminate one or more of the above-described challenges. The foregoing discussion is intended only to illustrate examples of the present field and should not be taken as a disavowal of scope.

SUMMARY

In embodiments, an electrical unit may include a housing member, a circuit board, a header connected to the housing member, and/or a plurality of electrical terminals disposed in the header and connected to the circuit board. The header may be connected to the housing member such that movement of the header is restricted and forces applied to the circuit board via the housing member are limited. The header may include a retainer configured to retain the header relative to the housing member. The housing member may include a latch configured to engage the retainer.

In embodiments, a method of assembling a junction box may include providing a housing member, providing a circuit board, providing a header, connecting electrical terminals of the header to the circuit board, connecting the header to the housing member, and/or restricting the header from applying forces to the circuit board. A connector may be connected with the electrical terminals.

The foregoing and other aspects, features, details, utilities, and advantages of the present disclosure will be apparent from reading the following description, and from reviewing the accompanying drawings.

DETAILED DESCRIPTION

Reference will now be made in detail to embodiments of the present disclosure, examples of which are described herein and illustrated in the accompanying drawings. While the disclosure will be described in conjunction with embodiments, it will be understood that they are not intended to limit the disclosure to these embodiments. On the contrary, the disclosure is intended to cover alternatives, modifications and equivalents, which may be included within the spirit and scope of the disclosure.

Figure 1:
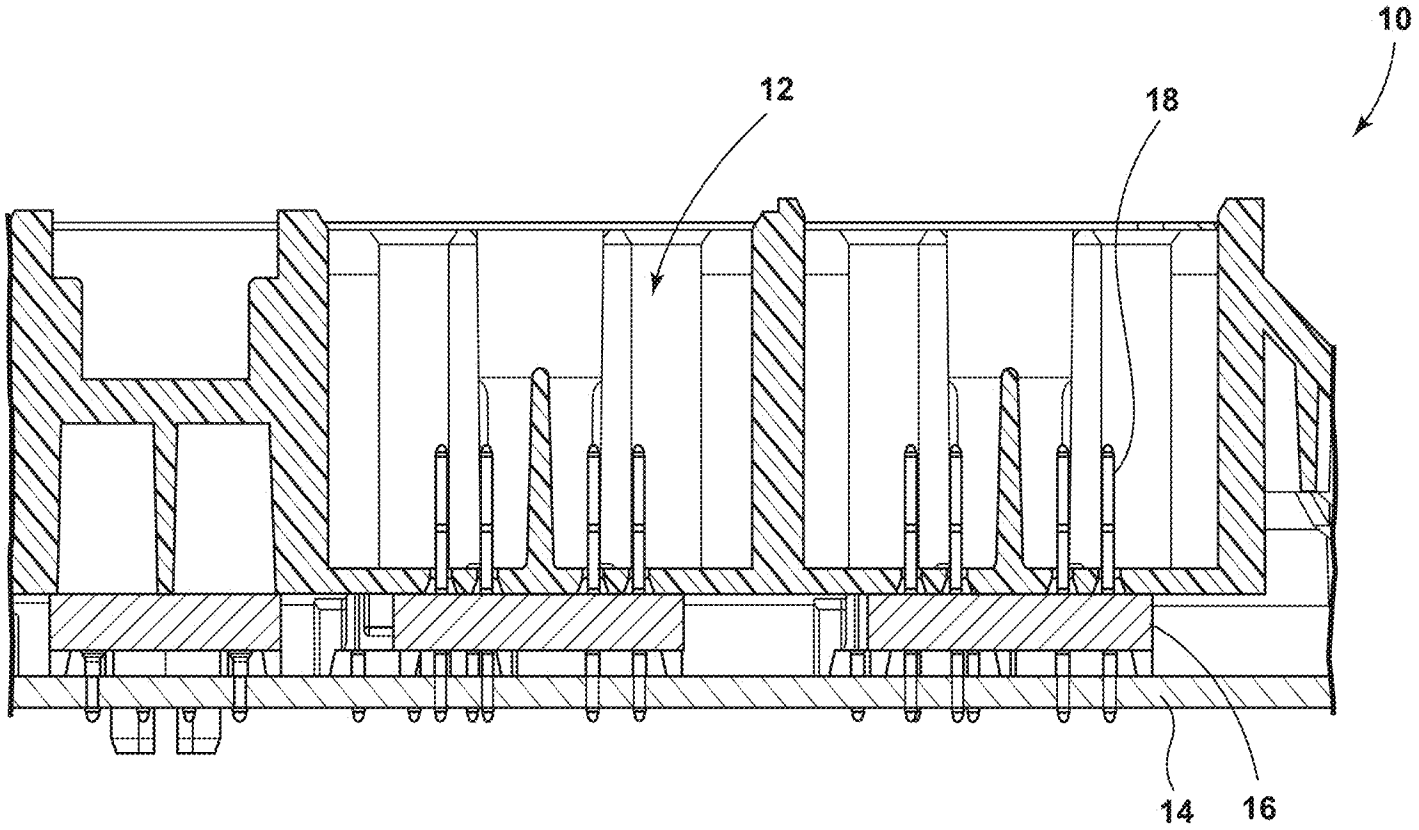
FIG. 1 is a cross section of an electrical unit with a housing member, a circuit board, and a header.

As generally illustrated in FIG. 1, an electrical unit 10 may include a housing member 12, a circuit board 14, a header 16, and one or more terminals 18. The one or more terminals 18 may be disposed in header 16 and/or may be connected to circuit board 14. Circuit board 14 may include, for example, a printed circuit board (PCB).

Figure 2A:
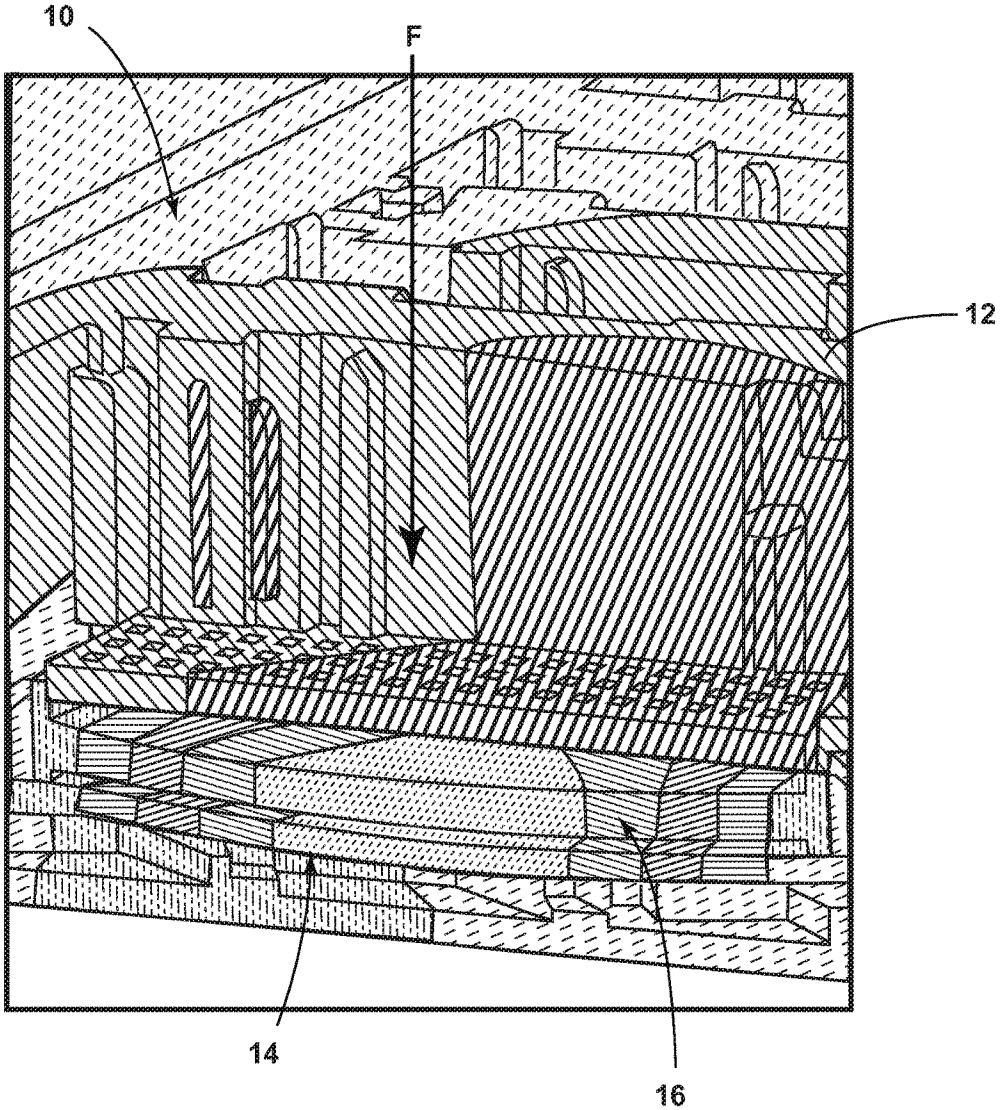
FIG. 2A is a finite element analysis (FEA) image of a cross section an electrical unit with a housing member, a circuit board, and a header during a mating operation.
Figure 2B:
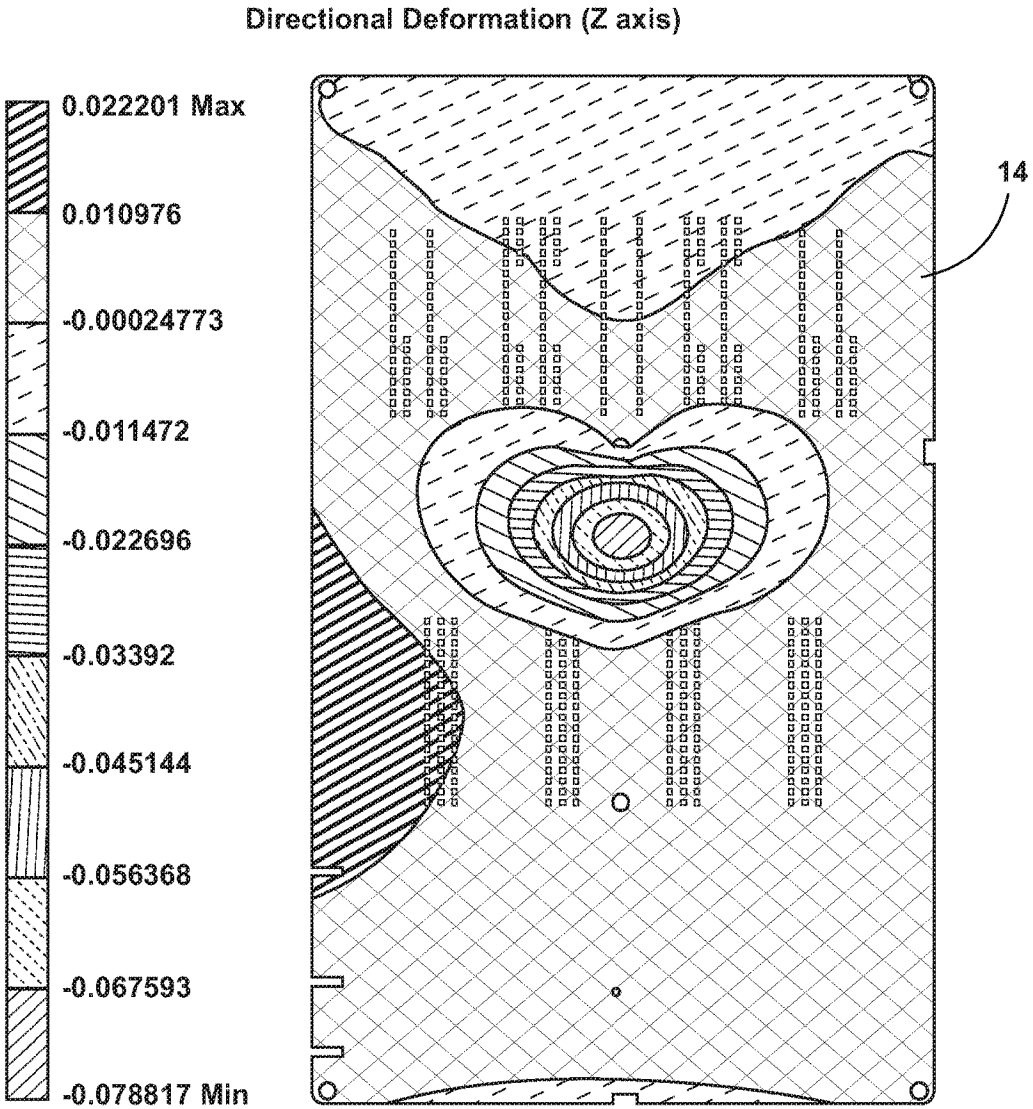
FIG. 2B is an FEA image of a circuit board during a mating operation.
Figure 3A:
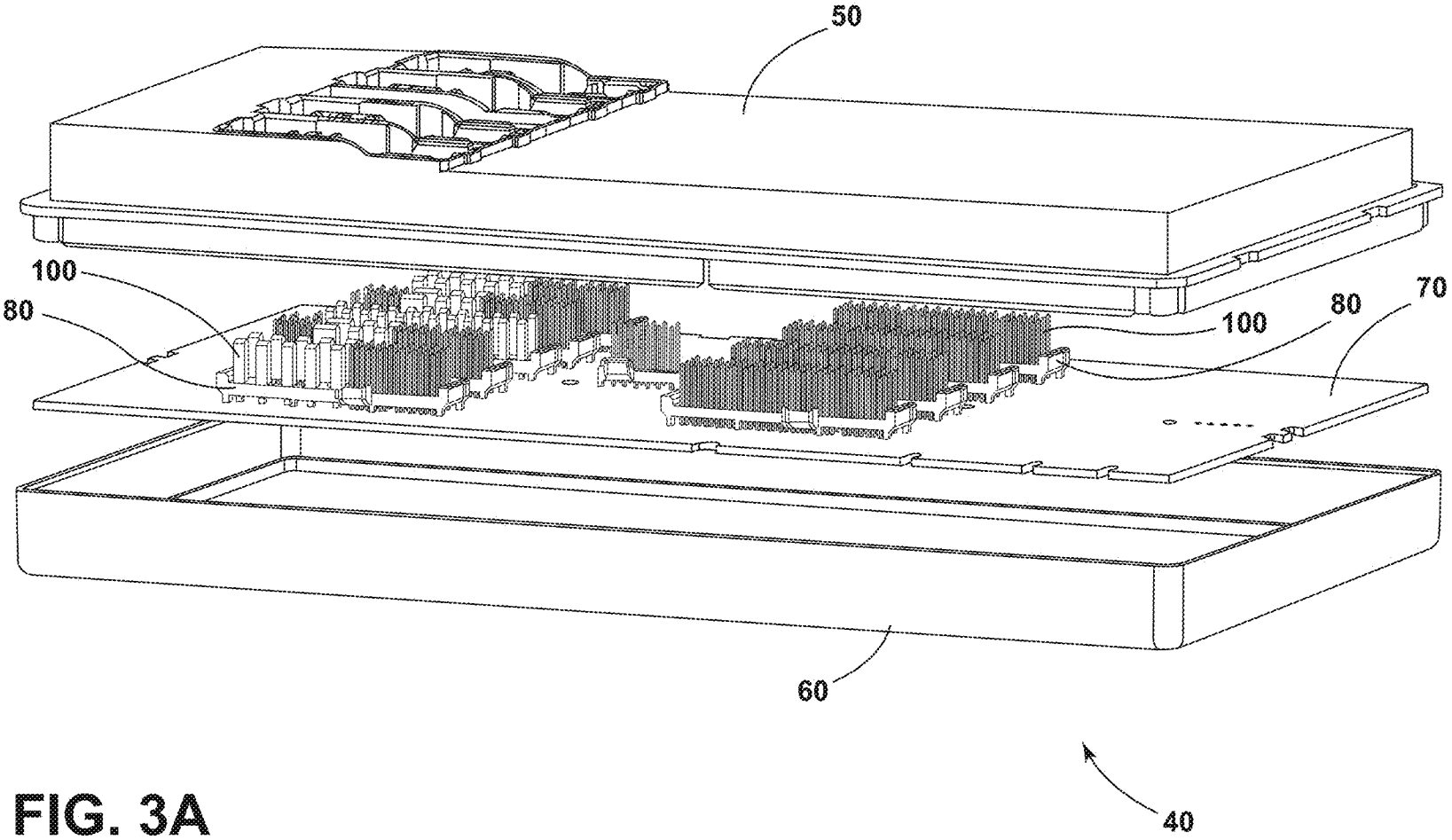
FIG. 3A is an exploded perspective view of an embodiment of an electrical unit with a first housing member, a second housing member, a circuit board, and a plurality of headers in accordance with teachings of the present disclosure.
Figure 3B:
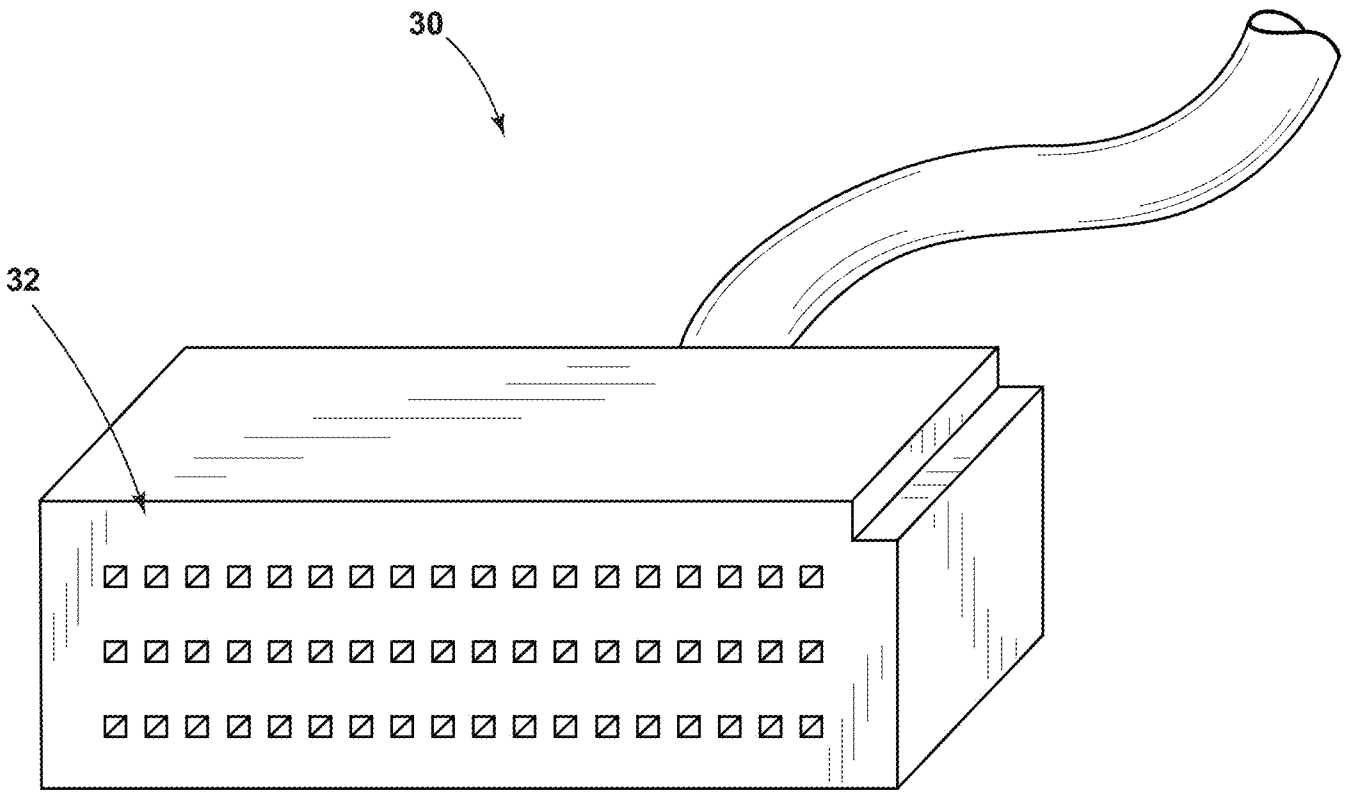
FIG. 3B is perspective view of an embodiment of a connector.
Figure 4:
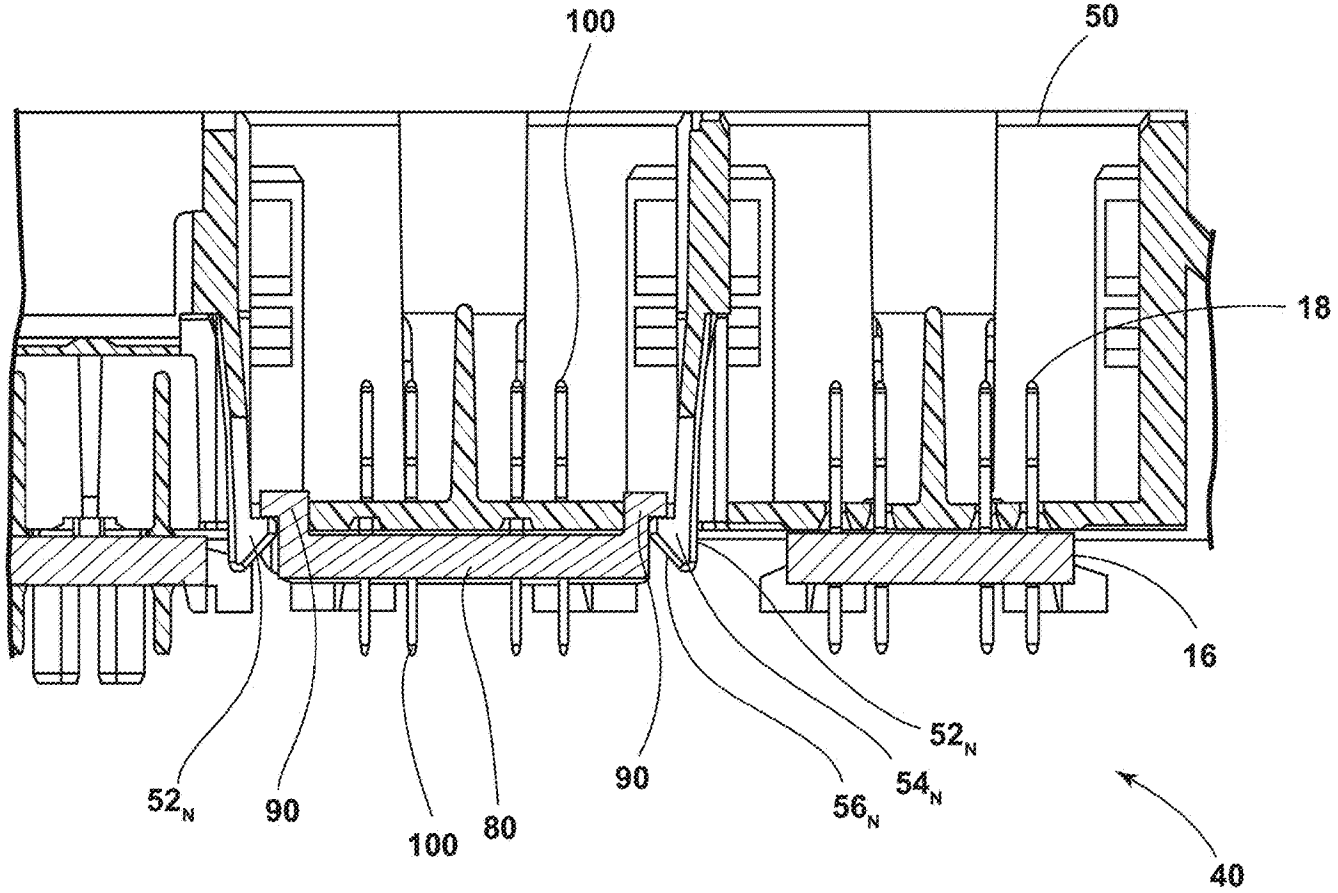
FIG. 4 is a cross-sectional view of an embodiment of an electrical unit with a housing member, a header, and a circuit board according to teachings of the present disclosure.
Figure 5:
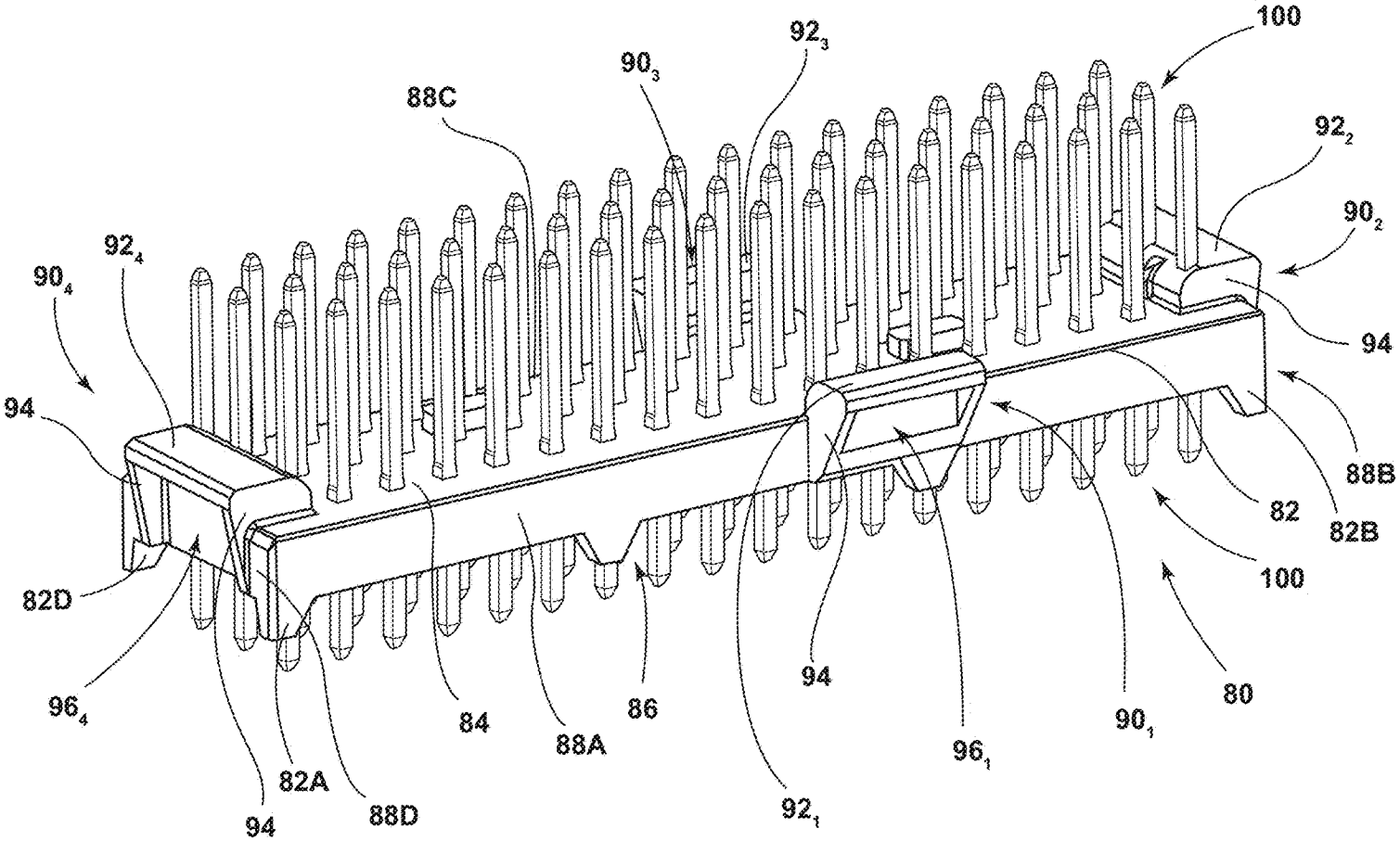
FIG. 5 is a perspective view of an embodiment of a header with electrical terminals according to teachings of the present disclosure.
Figure 6:
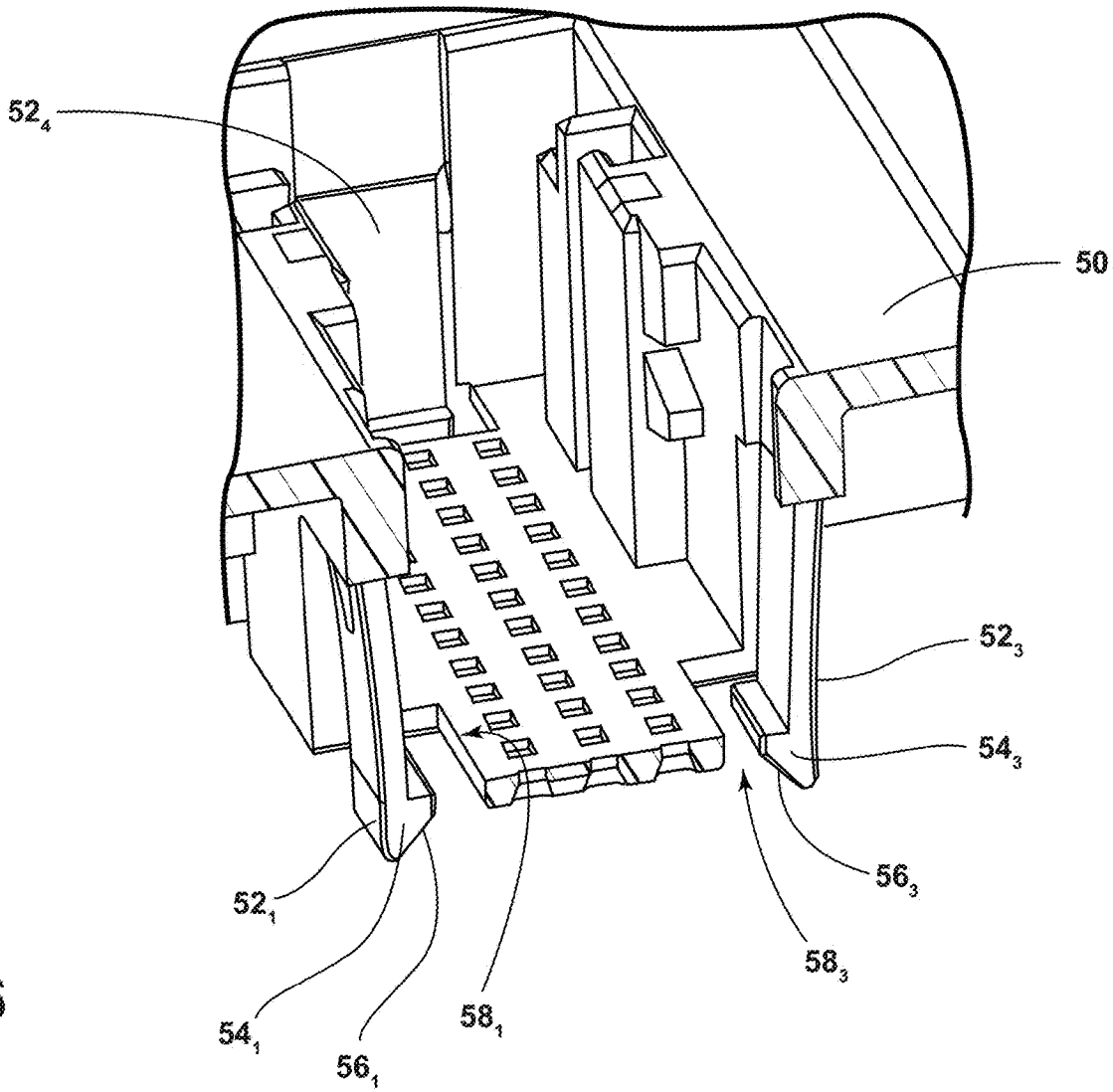
FIG. 6 is a cross-sectional view of an embodiment of a housing member according to teachings of the present disclosure.

Electrical unit 10 may be configured for connection with a connector (see, e.g., FIG. 3B). As generally illustrated in FIGS. 2A and 2B, which include FEA images during a mating operation (e.g., connection/mating of electrical unit 10 and terminals 18 with connector 30), forces F may be applied to electrical unit 10, header 16, and/or circuit board 14 during mating. For example, and without limitation, connecting connector 30 with the one or more terminals 18 may apply a force F to header 16 and/or terminals 18 toward circuit board 14 and the force F may be sufficiently large that a relatively significant amount of the force F may be transferred/applied to circuit board 14. In some instances, the amount of force F transferred/applied to circuit board 14 may result in more deformation/strain of the circuit board than is desired (e.g., more than a threshold amount of deformation/strain). Increased deformation/strain of circuit board 14 may damage circuit board 14 and/or may damage components connected to circuit board 14, such as surface mount devices (SMDs).

In embodiments, such as generally illustrated in FIGS. 3A and 3B, an electrical unit 40 may include a first housing member 50, a second housing member 60, a circuit board 70, one or more headers 80, and one or more electrical terminals 100. Electrical unit 40 may be configured for connection with a connector 30, which may include connector 30 receiving at least a portion of one or more electrical terminals 100 and/or electrically connecting connector 30 with circuit board 70. Electrical unit 40 may include, for example, one or more electrical housings, electrical junction boxes, smart junction boxes, electronic control units, gateway units, body domain controllers, and/or power distribution boxes.

As generally illustrated in FIGS. 3A, 5, 6, 7A, and 7B, a header 80 may comprise one of more of a variety of shapes, sizes, configurations, and/or materials. Header 80 may be configured to support electrical terminals 100, such as before, during, and/or after connection with circuit board 70. Header 80 may include a body 82, which may include a top 84, a bottom 86, and one or more lateral sides 88A, 88B, 88C, 88D (e.g., left, right, front, and back if body 82 includes a generally rectangular shape). One or more electrical terminals 100 may be disposed in body 82. For example, and without limitation, electrical terminals 100 may extend beyond bottom 86 of header 80 for connection with circuit board 70 and/or electrical terminals 100 may extend beyond top 84 of header 80 for connection with a connector 30 (e.g., via extending through housing member 50). Header 80 may include one or more retainers $\mathbf{90}_N$ that may be configured to retain and/or restrict movement of header 80 relative to first housing member 50. For example, and without limitation, a header 80 may include four retainers $\mathbf{90}_1$, $\mathbf{90}_2$, $\mathbf{90}_3$, $\mathbf{90}_4$ that may be disposed at or about each lateral side 88A, 88B, 88C, 88D of header 80. Retainers $\mathbf{90}_N$ may extend generally away from body 82 horizontally/laterally (e.g., outward from lateral sides 88A, 88B, 88C, 88D), and/or vertically (e.g., from/above top 84, away from circuit board 70). Retainers $\mathbf{90}_N$ may include a flange $\mathbf{92}_N$ that may be configured to engage housing member 50 and/or that may be supported by one or more support portions 94. Retainer support portions 94 may be tapered such that the lateral depth of support portions 94 increases moving vertically away from header bottom 86 and/or away from circuit board 70.

As generally illustrated in FIGS. 3A, 4, 6, 7A, 7B and 7C, housing member 50 may include one or more latches $\mathbf{52}_N$ that may be configured to engage corresponding retainers $\mathbf{90}_N$ of a header 80. For example, and without limitation, housing member 50 may include latches $\mathbf{52}_1$, $\mathbf{52}_2$, $\mathbf{52}_3$, $\mathbf{52}_4$ that may be configured to engage retainers $\mathbf{90}_k$, $\mathbf{90}_2$, $\mathbf{90}_3$, $\mathbf{90}_4$, respectively. Latches may extend generally vertically downward toward header 80 and/or circuit board 70. Latches $\mathbf{52}_N$ may include hooked portions $\mathbf{54}_N$ that may, for example, extend generally laterally inward. Flanges $\mathbf{92}_N$ of retainers $\mathbf{90}_N$ may include recesses $\mathbf{96}_N$ that may be configured to at least partially receive hooked portions $\mathbf{54}_N$. Hooked portions $\mathbf{54}_N$ may include tapered surfaces $\mathbf{56}_N$ that may be configured to engage retainers $\mathbf{90}_N$ upon connection of housing member 50 with header 80. Tapered surfaces $\mathbf{56}_N$ may cause latches $\mathbf{52}_N$ to deflect generally laterally outward upon initial contact with header 80. As housing member 50 and header 80 are moved closer together, hooked portions $\mathbf{54}_N$ may, for example, be configured to move slightly below retainers $\mathbf{90}_N$, which may allow latches $\mathbf{52}_N$ to snap back (e.g., laterally inward) such that hooked portions $\mathbf{54}_N$ engage flange recesses $\mathbf{96}_N$. Latches $\mathbf{52}_N$ may be at least somewhat resilient and/or may be biased laterally inward (e.g., into contact with header 80). Header 80 may be disposed at least partially between housing member 50 and circuit board 70.

Figure 7A:
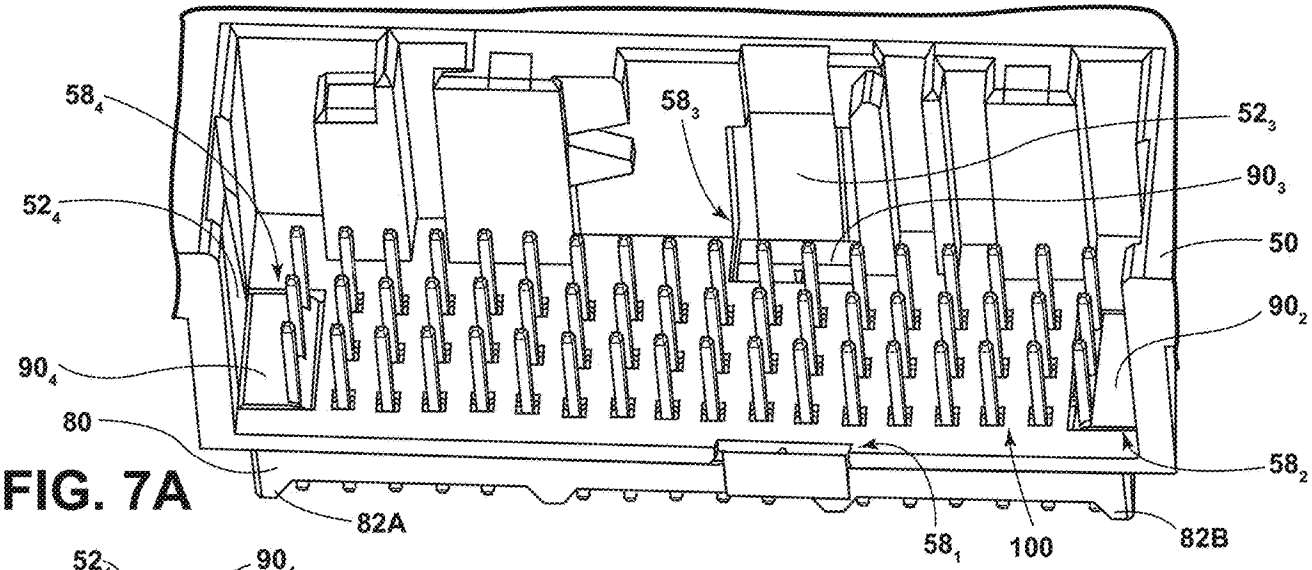
FIGS. 7A and 7B are cross-sectional views of embodiments of housing members and headers according to teachings of the present disclosure.
Figure 7C:
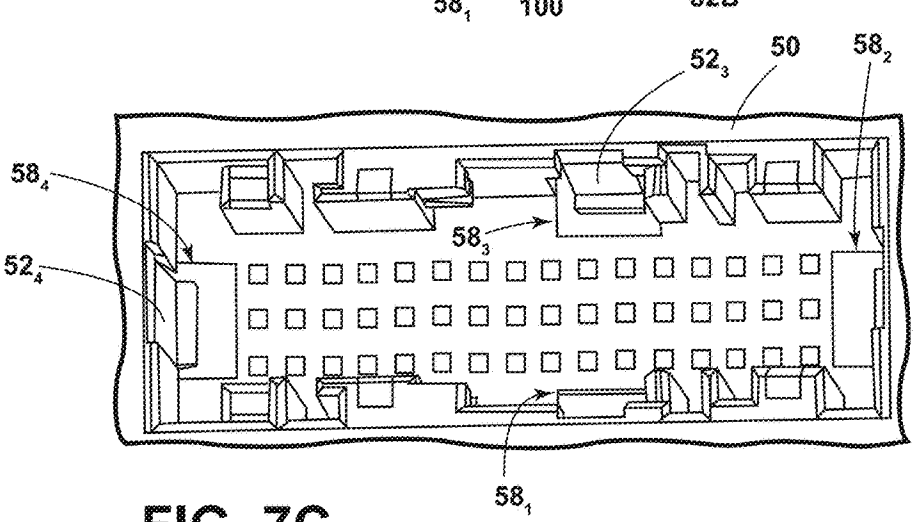
FIG. 7C is a top view of an embodiment of a housing member according to teachings of the present disclosure.
Figure 7B:
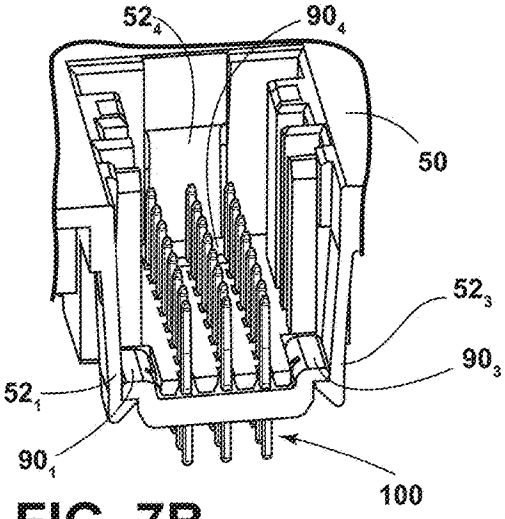

As generally illustrated in FIGS. 7A, 7B, and 7C, in embodiments, housing member 50 may be configured to at least partially receive retainers $\mathbf{90}_N$. For example, and without limitation, housing member 50 may include a retainer cut-out portion or aperture (e.g., aperture $\mathbf{58}_N$) for each retainer (e.g., four retainer apertures $\mathbf{58}_1$, $\mathbf{58}_2$, $\mathbf{58}_3$, $\mathbf{58}_4$). Retainer apertures $\mathbf{58}_N$ may receive at least portions of retainers $\mathbf{90}_N$ such that retainers $\mathbf{90}_N$ extend into housing member 50. Latches $\mathbf{52}_N$ may, for example, extend adjacent to or through retainer apertures $\mathbf{58}_N$. With embodiments, retainers $\mathbf{90}_N$ may or may not be the only portions of header 80 disposed at least partially in housing member 50.

With embodiments, a method of assembling an electrical unit 40 (e.g., an electrical housing and/or junction box) may include providing a first housing member 50, a second housing member 60, a circuit board 70 (e.g., a PCB), and/or a header 80. Header 80 may be provided with one or more electrical terminals 100 that may be configured for connection with a connector 30 (e.g., of a wiring harness). The method may include connecting electrical terminals 100 to circuit board 70, which may include inserting electrical terminals 100 into and/or through circuit board 70 and connecting or fixing electrical terminals 100 to circuit board 70, such as via soldering. First housing member 50 may be connected to header 80. Connecting housing member 50 to header 80 may include disposing housing member 50 over header 80, aligning retainer apertures $\mathbf{58}_N$ of housing member 50 with retainers $\mathbf{90}_N$ of header 80, and/or sliding housing member 50 toward header 80. As housing member 50 and header 80 come into contact, latches $\mathbf{52}_N$ may initially deflect laterally outward as tapered surfaces $\mathbf{56}_N$ contact retainers $\mathbf{90}_N$. If housing member 50 and header 80 are moved closer together, hooked portions $\mathbf{54}_N$ may move below retainers $\mathbf{90}_N$, which may allow latches $\mathbf{52}_N$ to snap back (e.g., laterally inward) such that hooked portions $\mathbf{54}_N$ engage flange recesses $\mathbf{96}_N$. The method may include retaining header 80 relative to housing member 50 via engagement between latches $\mathbf{52}_N$ and retainers $\mathbf{90}_N$ (e.g., between hooked portions $\mathbf{54}_N$ and flange recesses $\mathbf{96}_N$). Retaining header 80 relative to housing member 50 may include restricting vertical movement of header 80 (e.g., downward movement of header 80), which may limit the forces applied to circuit board 70 and/or flexing of circuit board 70.

Figure 8B:
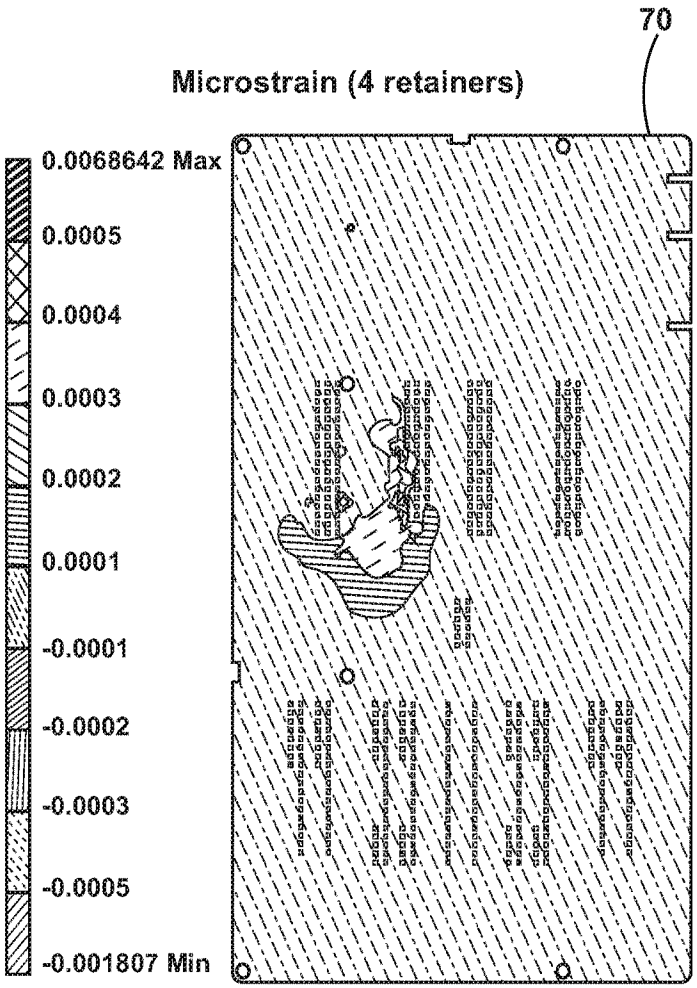
FIG. 8B is an FEA image of a circuit board during a mating operation with movement of a header restricted via a housing member and four retainers according to teachings of the present disclosure.
Figure 8A:
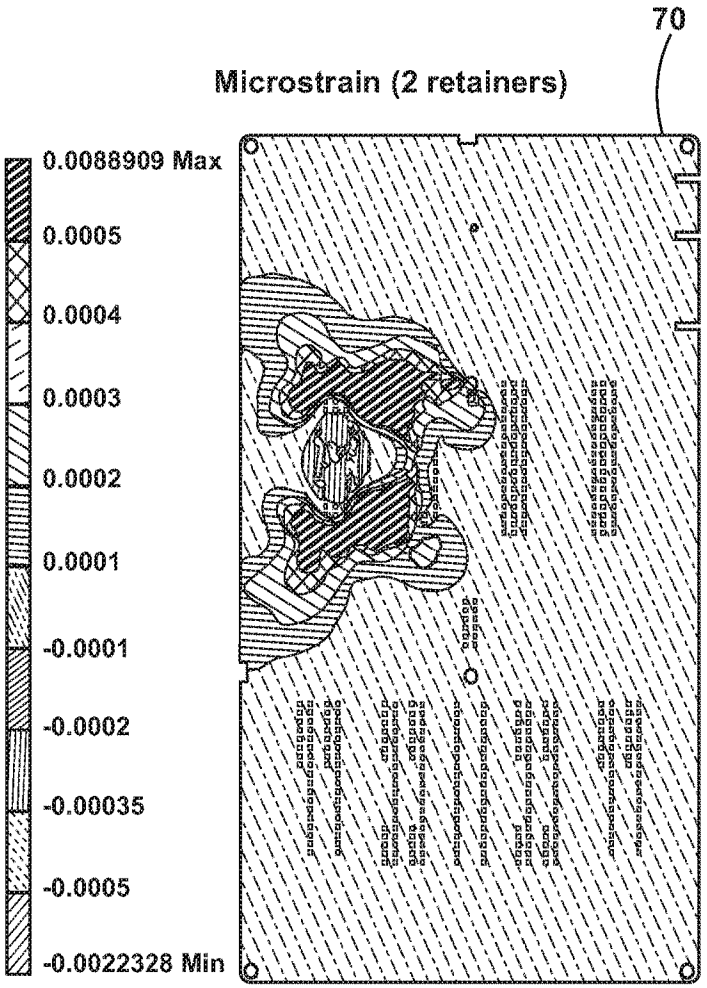
FIG. 8A is an FEA image of an embodiment of a circuit board during a mating operation with movement of a header restricted via a housing member and two retainers according to teachings of the present disclosure.

An assembly method (e.g., in a vehicle) may include connecting a connector 30 to electrical terminals 100 of header 80. Connecting connector 30 to electrical terminals 100 may include moving connector 30 downward toward housing member 50 such that apertures 32 of connector 30 receive electrical terminals 100. Connecting/mating may continue until electrical terminals 100 are fully inserted into connector 30. During connecting/mating, connector 30 may apply a downward vertical force F to header 80, such as via electrical terminals 100. Latches $\mathbf{52}_N$ and retainers $\mathbf{90}_N$ may cooperate to limit the downward movement of header 80 in response to such downward vertical force F, which may limit the downward force F applied to circuit board 70 during connecting/mating. Limiting the downward force F applied to circuit board 70 may limit the amount of deflection/deformation of circuit board 70, which may prevent damage to circuit board 70 and/or components connected to circuit board (e.g., SMDs). For example, and without limitation, FIGS. 8A and 8B include FEA images illustrating microstrain of a circuit board 70 during mating using a header 80 with two retainers $\mathbf{90}_N$ and a header 80 with four retainers $\mathbf{90}_N$, respectively. As generally illustrated, a header 80 with four retainers $\mathbf{90}_N$ may limit strain and/or deformation of circuit board 70 to a greater degree than a header 80 with two retainers $\mathbf{90}_N$.

With embodiments, latches $\mathbf{52}_N$ and retainers $\mathbf{90}_N$ may or may not be configured to limit movement of housing member 50 toward circuit board 70. For example, and without limitation, latches $\mathbf{52}_N$ and retainers $\mathbf{90}_N$ may limit movement of housing member 50 away from circuit board 70 (e.g., via connection (a) between electrical terminals 100 and circuit board 70, (b) between electrical terminals 100 and header 80, and (c) between retainers $\mathbf{90}_N$ of header 80 and latches $\mathbf{52}_N$ of housing member 50), but latches $\mathbf{52}_N$ and retainers $\mathbf{90}_N$ may not, on their own, limit movement of housing member 50 toward circuit board 70.

In embodiments, such as generally illustrated in FIGS. 9-12, an electrical unit, such as electrical units 10, 40, may include an adhesive 110. Adhesive 110 may include one or more of a variety of shapes, sizes, configurations, and/or materials. For example, and without limitations, adhesive 110 may include an adhesive foil. Adhesive 110 may be disposed between a header 16, 80 and a housing member 12, 50. Adhesive 110 may be configured to limit and/or impede movement of a header 16, 80 away from a housing member 12, 50. In a manner that may be similar to that associated with retainers $\mathbf{90}_N$, adhesive 110 may retain a header 16, 80 relative to housing member 50, which may limit the forces F applied to circuit board 70 and/or flexing of circuit board 70.

Figure 9:
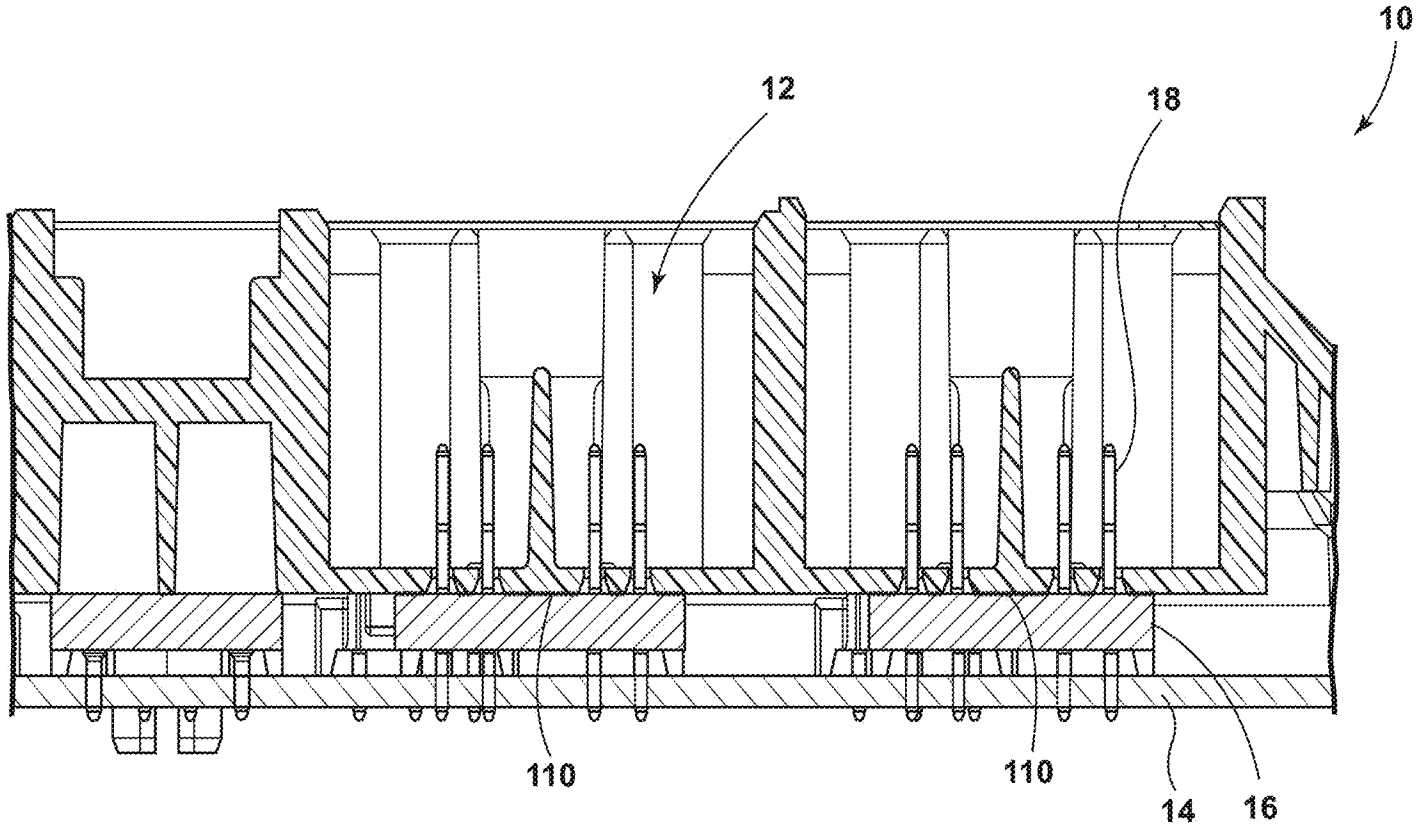
FIG. 9 is a cross section of an electrical unit with a housing member, a circuit board, a header, and an adhesive.
Figure 10:
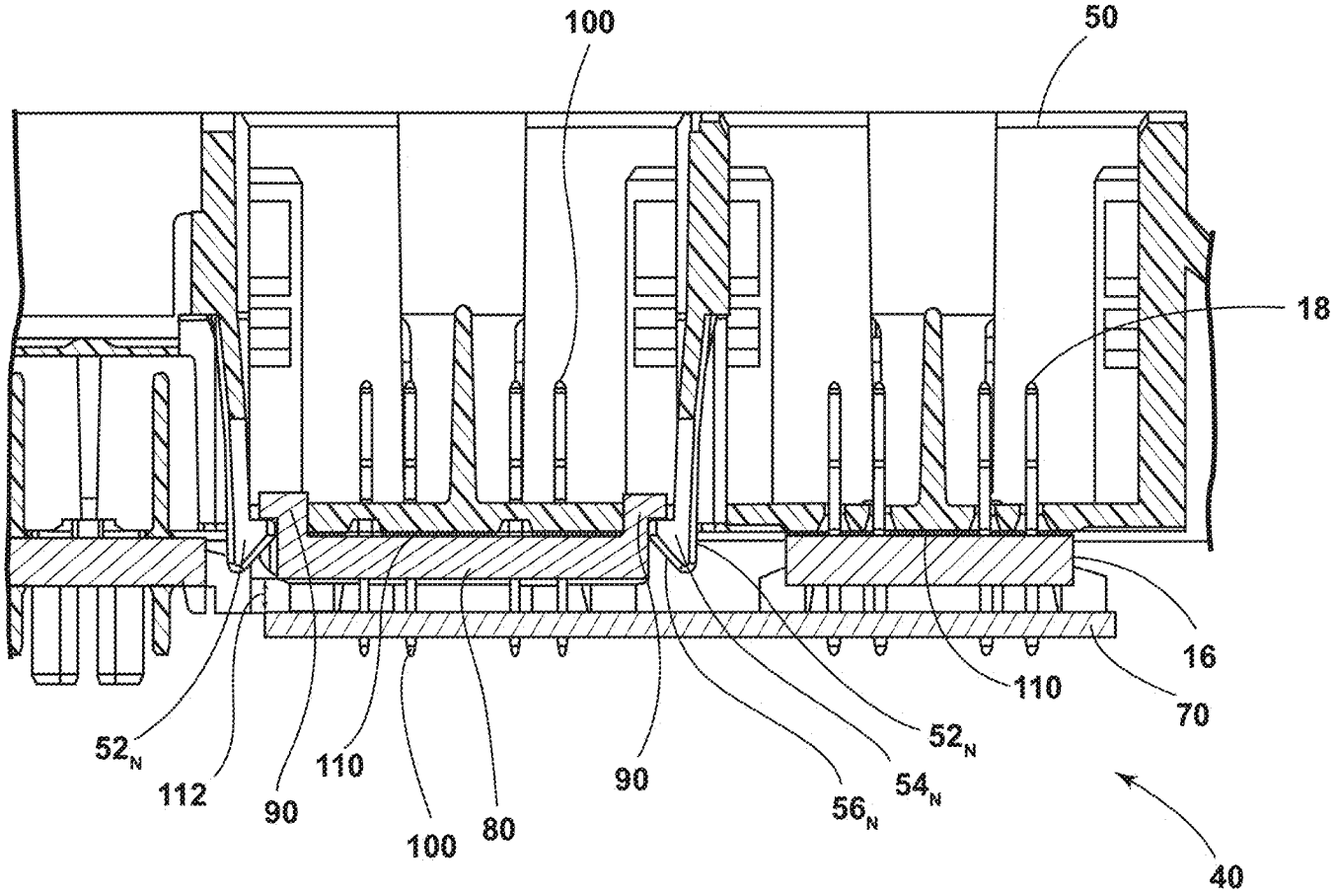
FIG. 10 is a cross-sectional view of an embodiment of an electrical unit with a housing member, a header, an adhesive, and a circuit board according to teachings of the present disclosure.
Figure 11:
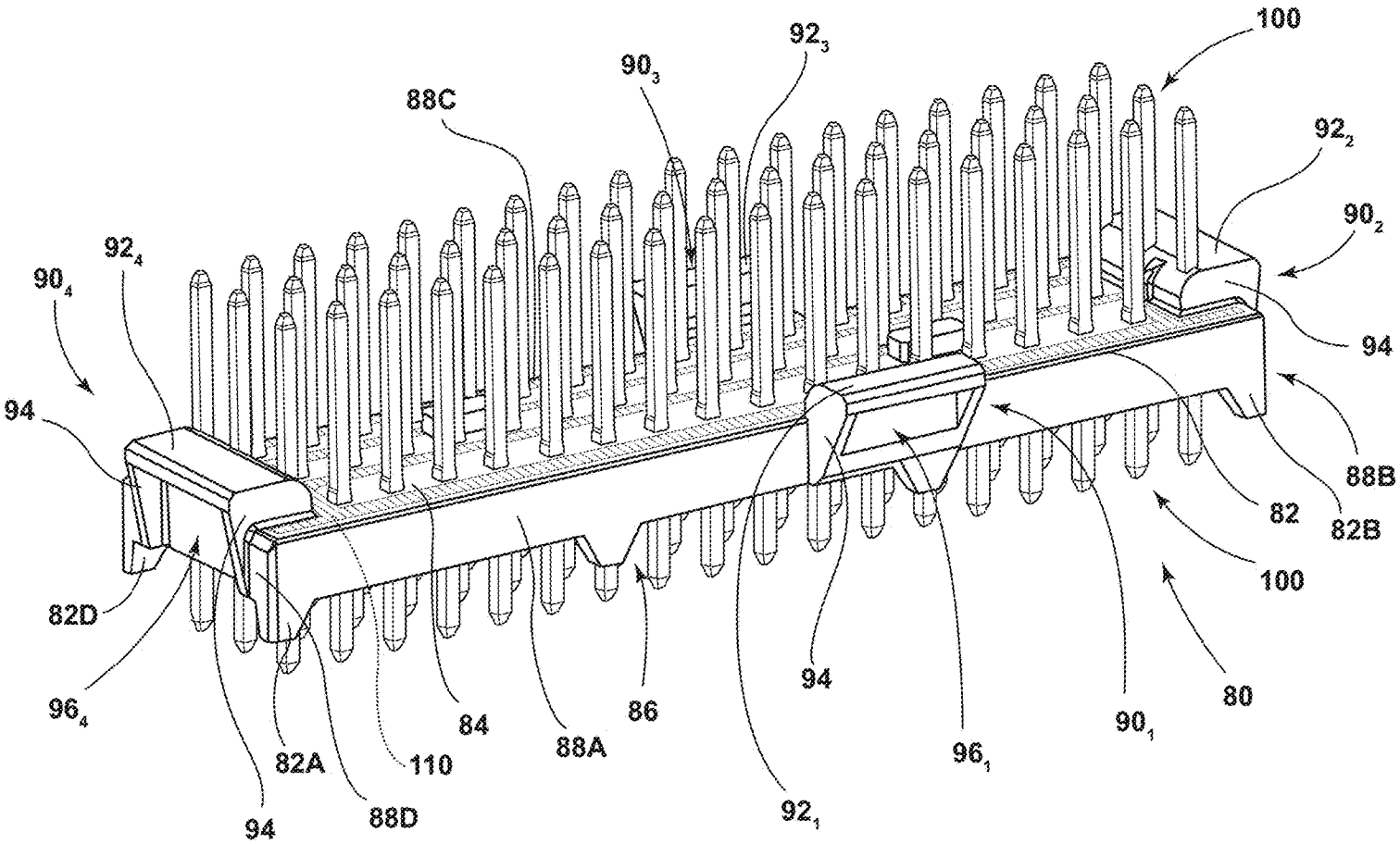
FIG. 11 is a perspective view of an embodiment of a header with electrical terminals and adhesive according to teachings of the present disclosure.
Figure 12:
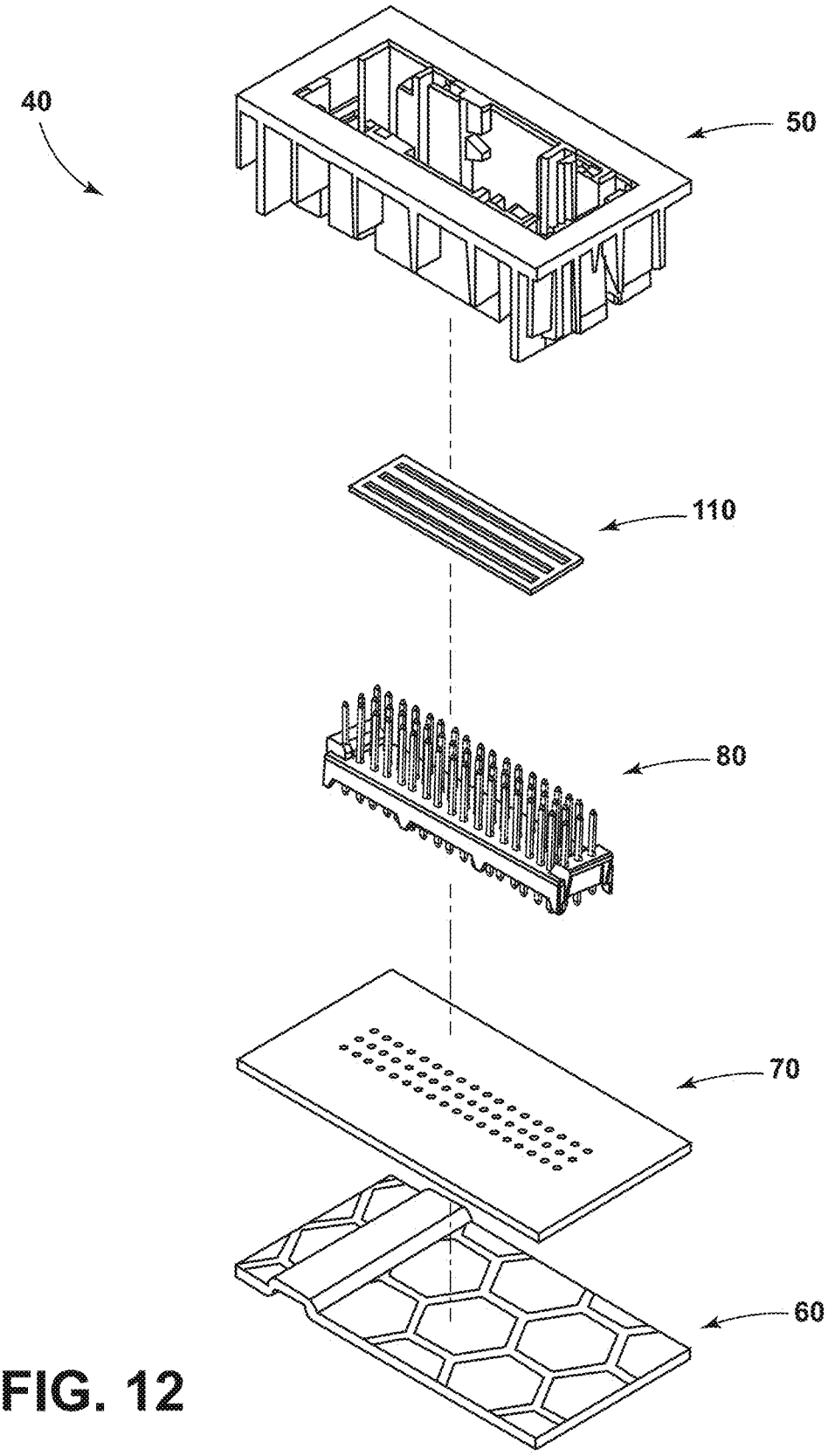
FIG. 12 is an exploded perspective view of an embodiment of an electrical unit with a first housing member, a second housing member, a circuit board, an adhesive, and a header in accordance with teachings of the present disclosure.

As generally illustrated in FIG. 9, adhesive 110 may be used with a header 16 that does not include retainers $\mathbf{90}_N$, in embodiments. As generally illustrated in FIG. 10, adhesive 110 may be used with a header 80 that includes retainers $\mathbf{90}_N$ (e.g., an electrical unit 40 may include both retainers $\mathbf{90}_N$ and adhesive 110). With embodiments, such as generally illustrated in FIGS. 11 and 12, adhesive 110 may be connected to a header 80 in one or more of a variety of configurations. Adhesive 110 may be connected at or about edges of header 80, at or about middle/central sections of header 80, and/or between terminals 100. Disposing adhesive 110 at or about middle/central sections of header 80 and/or between terminals 100 may help limit/prevent movement of the middle sections, which that may be disposed at greater distances from retainers $\mathbf{90}_N$ that other sections of header 80, away from housing member 50. Terminals 100 may be disposed in rows and/or columns and adhesive 110 may be disposed between one or more of the rows and/or between the columns. For example, and without limitation, adhesive 110 may be disposed between each row of terminals 100 and/or along the perimeter of terminals 100 and/or header 80.

In embodiments, circuit board 70, header 80, adhesive 110, and/or first housing member 50 may be disposed generally parallel to each other and/or to the same plane (e.g., a horizontal plane). Circuit board 70, header 80, adhesive 110, and/or first housing member 50 may be disposed substantially adjacent to each other. A gap 112 (e.g., a vertical gap) may be disposed and/or present between header 80 and circuit board 70 (e.g., header body 82 may be spaced from circuit board 70, such as via feet 82A, 82B, 82D of header 80).

With embodiments, a method of assembling an electrical unit 40 (e.g., an electrical housing and/or junction box) may include providing a first housing member 50, a second housing member 60, a circuit board 70 (e.g., a PCB), a header 80, and/or an adhesive 110. Header 80 may be provided with one or more electrical terminals 100 that may be configured for connection with a connector 30 (e.g., of a wiring harness). The method may include connecting electrical terminals 100 to circuit board 70, which may include inserting electrical terminals 100 into and/or through circuit board 70 and connecting or fixing electrical terminals 100 to circuit board 70, such as via soldering. Adhesive 110 may be connected to header 80 and/or to first housing member 50. First housing member 50 may be connected to header 80. Connecting housing member 50 to header 80 may include disposing housing member 50 over header 80, aligning retainer apertures $\mathbf{58}_N$ of housing member 50 with retainers $\mathbf{90}_N$ of header 80, and/or sliding housing member 50 toward header 80. As housing member 50 and header 80 come into contact, latches $\mathbf{52}_N$ may initially deflect laterally outward as tapered surfaces $\mathbf{56}_N$ contact retainers $\mathbf{90}_N$. If housing member 50 and header 80 are moved closer together, hooked portions $\mathbf{54}_N$ may move below retainers $\mathbf{90}_N$, which may allow latches $\mathbf{52}_N$ to snap back (e.g., laterally inward) such that hooked portions $\mathbf{54}_N$ engage flange recesses $\mathbf{96}_N$. Connecting first housing member 50 with header 80 may include connecting adhesive 110 to one or both of housing member 50 and header 80. For example, and without limitation, adhesive may be initially connected with (e.g., adhered to) header 80. As first housing member 50 and header 80 come together, adhesive may connect with first housing member 50, which may connect/bond first housing member 50 and header 80 together. In embodiments, adhesive 110 may be initially connected with first housing member 50. As first housing member 50 and header 80 come together, adhesive 110 may connect with first housing member 50, which may connect/bond first housing member 50 and header 80 together. With embodiments, adhesive 110 may be initially connected with first housing member 50 and header 80. As first housing member 50 and header 80 come together, adhesive 110 connected with first housing member 50 may connect/bond with adhesive 110 connected with header 80 (e.g., adhesive 110 may bond with itself and/or may include a two-part epoxy), which may connect/bond first housing member 50 and header 80 together.

A method of assembly may include retaining header 80 relative to housing member 50 via (i) engagement between latches $\mathbf{52}_N$ and retainers $\mathbf{90}_N$ (e.g., between hooked portions $\mathbf{54}_N$ and flange recesses $\mathbf{96}_N$), and/or (ii) adhesive 110 binding first housing member 50 with header 80. Retaining header 80 relative to housing member 50 may include restricting vertical movement of header 80 (e.g., downward movement of header 80), which may limit the forces applied to circuit board 70 and/or flexing of circuit board 70.

With embodiments, retainers $\mathbf{90}_N$ may be configured to help ensure a proper or desired positioning of header 80 relative to housing member 50. For example, and without limitation, retainers $\mathbf{90}_N$ may at least initially align and/or connect header 80 with housing member 50, such as prior to adhesive 110 completely curing (e.g., retainers $\mathbf{90}_N$ may help hold header 80 against housing member 50). This configuration may simplify and/or accelerate assembly such that an assembly process may not involve waiting for adhesive 110 to cure. In embodiments, adhesive 110 may be configured to provide sufficient resistance to movement of header 80 away from housing member 50 such that additional resistance, such as from retainers $\mathbf{90}_N$, may not be needed. Such an arrangement may permit retainers $\mathbf{90}_N$ to be weaker and/or include less expensive materials as retainers $\mathbf{90}_N$ may not be intended to connect header 80 to housing member 50 on their own.

Various embodiments are described herein for various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "with embodiments," "in embodiments," or "an embodiment," or the like, means that a particular feature, structure, or characteristic described in connection with the embodiment is included in at least one embodiment. Thus, appearances of the phrases "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It should be understood that references to a single element are not so limited and may include one or more of such element. All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." throughout the specification is to be construed broadly and is used to provide non-limiting examples of embodiments of the disclosure, and the disclosure is not limited to such examples. It is intended that all matter contained in the above description or shown in the accompanying drawings shall be interpreted as illustrative only and not limiting. Changes in detail or structure may be made without departing from the present disclosure.

Furthermore, the mixing and matching of features, elements and/or functions between various examples is expressly contemplated herein so that one of ordinary skill in the art would appreciate from this disclosure that features, elements, and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present teachings not be limited to the particular examples illustrated by the drawings and described in the specification.

What is claimed is:

1. An electrical unit, comprising:

a housing member including an external recess configured to at least partially receive an electrical connector;

a circuit board;

a header connected to the housing member, the header including a retainer configured to retain the header relative to the housing member; and a plurality of electrical terminals disposed in the header and connected to the circuit board;

wherein the header is connected to the housing member such that movement of the header is restricted and the housing member limits forces applied to the circuit board from the plurality of electrical terminals; the housing member includes a cut-out portion or aperture; a portion of the retainer extends through the cut-out portion or aperture; and, the cut-out portion or aperture is disposed in a portion of the housing member disposed in parallel with the circuit board.

2. The electrical unit of claim 1, wherein the housing member includes a latch member configured to engage the retainer, and the latch member and the retainer cooperate to restrict movement of the header and limit forces applied to the circuit board from the plurality of electrical terminals.

3. The electrical unit of claim 1, wherein the header includes a plurality of retainers configured to retain the header relative to the housing member, the housing member includes a plurality of latches that extend toward the circuit board, the plurality of latches are configured to engage the plurality of retainers, and the plurality of latches and the plurality of retainers cooperate to restrict movement of the header and limit forces applied to the circuit board from the plurality of electrical terminals.

4. The electrical unit of claim 3, wherein at least one of the plurality of retainers includes a recess configured to receive a hooked portion of a latch of the plurality of latches.

5. The electrical unit of claim 4, wherein the hooked portion includes a tapered surface configured to engage the at least one of the plurality of retainers.

6. The electrical unit of claim 3, wherein at least one retainer of the plurality of retainers is disposed at or about each lateral side of the header and the header includes four lateral sides.

7. The electrical unit of claim 1, wherein a gap is present between the header and the circuit board such that a body of the header is disposed at a distance from the circuit board.

8. The electrical unit of claim 2, wherein the latch member is configured to deflect laterally outward during mating of the housing member with the header.

9. The electrical unit of claim 8, wherein the latch member is biased laterally inward toward the header.

10. The electrical unit of claim 3, wherein the plurality of retainers extend laterally outward from a body of the header.

11. The electrical unit of claim 10, wherein the plurality of retainers extend vertically upward from the body and away from the circuit board.

12. The electrical unit of claim 2, wherein the latch member is disposed in the cut-out portion or aperture.

13. The electrical unit of claim 1, including an adhesive disposed between the plurality of electrical terminals and connected to the first housing member and the header.

14. The electrical unit of claim 13, wherein the at least some of the adhesive is disposed at a central section of the header.

15. The electrical unit of claim 13, wherein the header, the housing member, the circuit board, and the adhesive are disposed substantially parallel with each other.

16. A method of assembling a junction box, the method comprising:

providing a housing member including an external recess configured to at least partially receive an electrical connector;

providing a circuit board;

providing a header having electrical terminals;

connecting the electrical terminals of the header to the circuit board; and connecting the header to the housing member, after connecting the electrical terminals to the circuit board, such that the housing member restricts movement of the header to limit forces applied to the circuit board from the electrical terminals.

17. The method of claim 16, wherein the header includes a retainer configured to retain the header relative to the housing member and the header is monolithic.

18. The method of claim 17, wherein the housing member includes a latch configured to engage the retainer.

19. The method of claim 16, wherein the header includes a plurality of retainers configured to retain the header relative to the housing member, and the housing member includes a plurality of latches configured to engage the plurality of retainers.

20. The method of claim 19, wherein connecting the header to the housing member includes initially deflecting the plurality of latches laterally outward and snapping the latches inward to engage the plurality of retainers.

21. The method of claim 19, wherein connecting the header to the housing member includes inserting the retainers into corresponding apertures in the housing member, wherein the corresponding apertures are disposed in a portion of the housing member disposed in parallel with the circuit board.

22. The method of claim 16, wherein connecting the header to the housing member includes connecting the header and the housing member via an adhesive.

23. The method of claim 22, wherein the header, the housing member, the circuit board, and the adhesive are disposed generally parallel to a horizontal plane.

* * * * *